US005080314A

United States Patent [19]

Moyer et al.

[11] Patent Number: 5,080,314

[45] Date of Patent: Jan. 14, 1992

[54] ROLL STACKER

[75] Inventors: Mark A. Moyer, Bethel; Michael P. Grubb, Mount Joy, both of Pa.

[73] Assignee: Henry Molded Products, Inc., Lebanon, Pa.

[21] Appl. No.: 505,491

[22] Filed: Apr. 6, 1990

[51] Int. Cl.[5] ..... A47B 91/00

[52] U.S. Cl. ..... 248/346; 211/59.4; 206/391

[58] Field of Search ..... 248/346; 211/59.4, 60.1, 211/194; 206/391, 394, 416, 443, 597; 108/55.3, 51.3

[56] References Cited

U.S. PATENT DOCUMENTS

| | | | |
|---|---|---|---|
| 2,783,879 | 3/1957 | Emery | 206/443 |
| 3,196,229 | 7/1965 | Glass | 206/443 |
| 3,708,084 | 1/1973 | Bixler et al. | 206/443 X |
| 4,195,732 | 4/1980 | Bell | 206/391 |
| 4,610,362 | 9/1986 | Remp et al. | 211/59.4 |
| 4,705,170 | 11/1987 | Creaden | 206/443 X |
| 4,865,202 | 9/1989 | Day | 211/59.4 X |
| 4,901,870 | 2/1990 | Wright et al. | 211/59.4 |
| 4,936,453 | 6/1990 | Knitter | 206/443 X |

*Primary Examiner*—Gary L. Smith
*Assistant Examiner*—Michael J. Milano

[57] ABSTRACT

This invention relates to molded papier-maché supports for holding and spacing a plurality of rolls in a secure multi-layer stack. The supports are made of first and second sections connected to each other along a seam line. These sections are foldable to move a first section to a position beneath and in register with a second section. To strengthen the structure, the sections are formed with depressions which create lands. When in folded position, the lands on one support engage the lands on the other support. This stabilizes the structure.

5 Claims, 2 Drawing Sheets

ROLL STACKER

FIELD OF INVENTION

This invention relates to molded papier-maché supports for holding and spacing a plurality of rolls of material in a multilayer stack.

BACKGROUND OF THE INVENTION

Material such as paper, foil, various types of plastics, metal and the like is commonly stored and shipped in generally cylindrical rolls in a multi-layer stack. To prevent damage, it is desirable to have the rolls in each stack spaced from each other in secure locations. Further, the rolls need to be horizontally supported in a manner which does not damage the material in the rolls.

Heretofore, molded supports of polystyrene have been provided for this purpose. To make up a stack, there are middle support members molded to have upwardly facing indentations, each to receive the bottom surface of a roll, and downwardly facing indentations which seat on the upper surfaces of a lower layer of rolls. In addition, molded half supports are provided at the bottom of the stack on a pallet and half supports at the top of the stack. The bottom supports have a flat lower side with upwardly facing indentations for the lower tier of rolls. The supports at the top of the stack have downwardly facing indentations and a flat upper surface. The entire stack may be three, four or other desired number high and arranged to form a generally rectangular box-like stack which can be covered with plastic sheeting or other material and strapped to form a shipping or storage unit.

There are a number of disadvantages to polystyrene supports of this type. It is necessary to provide two molded components, one being the middle supports which have both upwardly and downwardly extending indentations to receive the rolls to be stacked, and half supports for the top and bottom of the stack. This requires separate molds for the two pieces. As a result, there are double part numbers and increased inventories of stack forming members. Polystyrene molded supports of this type are relatively costly.

Although molded polystyrene supports have some flexibility to accommodate roll variations, the degree of reformation is sometimes inadequate for the amount of variation encountered. In addition, when supports are shipped by truck or other means, or placed in inventory, they are not nestable or subject to only limited nesting. Thus, they take up substantial space.

When a stack is taken apart when the rolls are to be used, disposal of used polystyrene supports is a problem. The material from which they are molded is non-biodegradable. Disposal in a landfill is thus undesirable. If there is a fire, polystyrene supports give off dangerous fumes.

To overcome these problems with polystyrene supports, heretofore stack supports have been provided for rolls made of molded papier-maché in a single two section structure foldable along a seam to provide middle support sections with upwardly and downwardly extending roll engaging cavities, and the sections being easily separable to provide top and bottom pieces for use in the formation of a stack.

However, molded papier-maché supports may not have sufficient structural strength to handle heavy rolls. It is therefore necessary to design paper-maché supports which will hold up in use to provide a secure stack whether the supports are separated pieces at the top or bottom of a stacked or folded sections at the middle of a stack.

One object of this invention is to provide papier-maché stack supports having downwardly extending strengthening lands on two side-by-side support sections, the lands being engageable with a flat supporting surface when the sections are side-by-side, and the lands on one section being engageable with lands on the other section when the supports are pivoted and folded relative to each other to provide middle roll supports.

Another object of this invention is to provide molded papier-maché stack supports of a texture having flexibility whereby the fibers in the supports are subject to some remolding when engaged by heavy rolls, to accommodate rolls which may be somewhat undersized, oversized or out of round.

Another object of this invention is to provide stack supports of the type described wherein the cradles of the sections have sides along said seam sloped away from each other to facilitate pivoting of one section relative to its related section.

A further object of this invention is to provide stack supports as described and having a hole in each end of each section through which straps may be extended for wrapping a stack.

SUMMARY OF THE INVENTION

This invention provides supports for forming a stack of rolls in tiers, one on top of the other, to provide a generally rectangular box-like package suitable for storage or shipment. The stack supports are molded papier-maché. Each support has first and second co-planar support sections which extend side-by-side and are connected by a seam along a longitudinal edge. The sections having downwardly projecting lands which engage a flat supporting surface when the sections are side-by-side. The second support section is foldable along the seam line to pivot from a position at the side of the first section to a location beneath and in register with the first section. To strengthen the structure, the lands on the first section are engageable with the lands on the second section when the sections are folded and pivoted relative to each other to form middle supports. The cradles are provided with sloped sides to facilitate pivoting one section relative to the other, and both sections have end holes to receive straps for wrapping a stack.

DESCRIPTION OF PREFERRED EMBODIMENT

Figure 1:
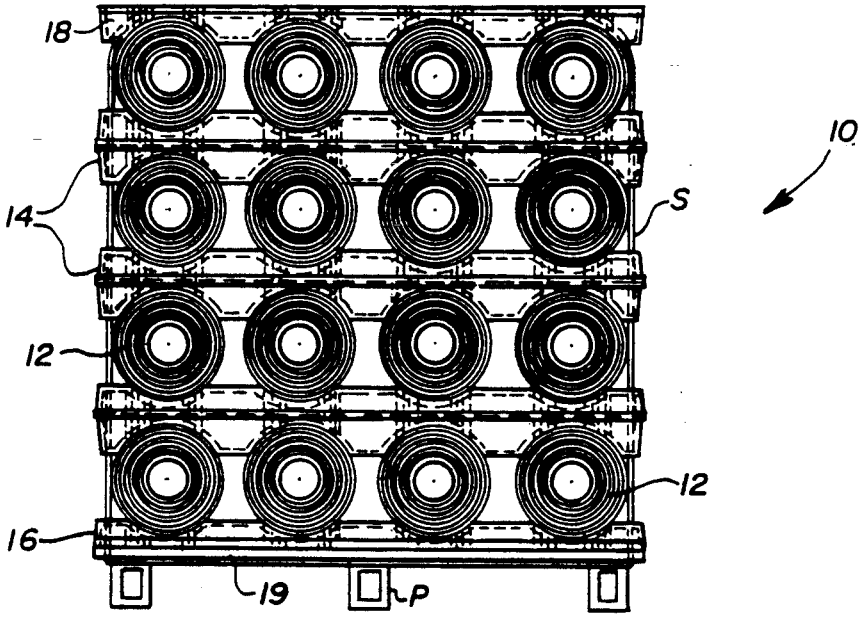
FIG. 1 is an end view of a multi-layer stack of rolls packaged together by molded papier-maché supports constructed according to this invention.
Figure 2:
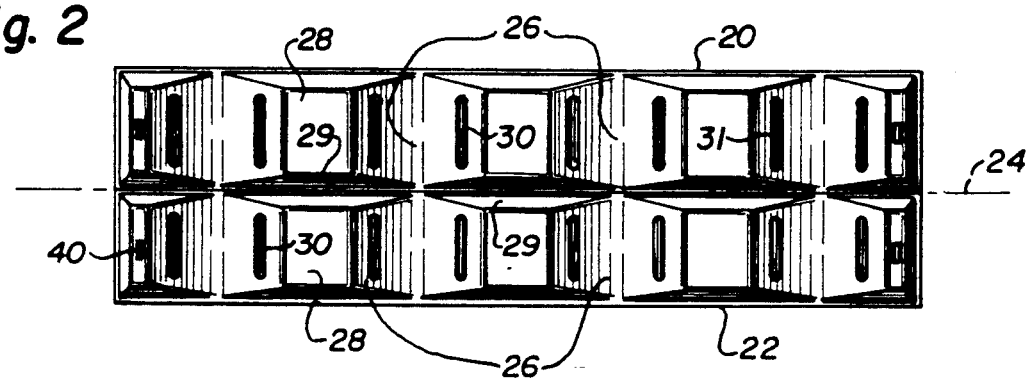
FIG. 2 is a plan view showing one of the molded supports of this invention, with its two side-by-side co-extensive support sections, interconnected.
Figure 3:
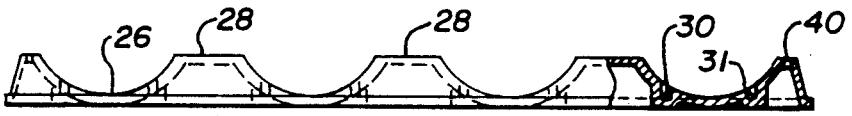
FIG. 3 is a side view of FIG. 2, with one end in vertical cross section.

Referring now to the drawings by numerals of reference and first to FIG. 1, 10 shows a package of rolls 12 arranged in multi-tiers, there being four tiers in the Figure. All rolls 12 are of generally the same diameter, except for limited variations. The axes of the rolls extend horizontally and parallel to each other. The rolls are separated from each other. These rolls may be of any type of material such as foil, plastic, paper, metal or other material.

The rolls are secured in the positions shown by supports of this invention including middle supports 14, and bottom and top supports 16 and 18, respectively. The stack or roll package is mounted on a pallet P having a flat upper surface 19 on which the lower supports 16 rest.

The papier-maché middle supports 14 are formed and molded as shown in FIG. 2–6. There is a first section 20 and a second section 22 interconnected by a longitudinal seam indicated by line 24, along adjacent edges of the first and second sections. As shown best in FIG. 5, seam 24 is formed by a V-shaped cut out 25 in the papier-maché to form a line of reduced thickness material whereby the molded sections 20–22 may be easily pivoted relative to each other or separated along line 24.

The sections 20 and 22 are of the same molded construction. Each has a series of longitudinally spaced transverse cradles or pockets 26 to receive the rolls 12. The cradles 26 are separated and spaced by wall sections or dividers 28 whereby the peripheries of the rolls are spaced from each other. The cradles 26 have a curvature to match the surfaces of the rolls to be supported. As shown, each cradle has a depth less than the radius of the roll which it carries. When molded, the cradles 26 in first section 20 are in alignment with the cradles in second section 22.

Figure 6:
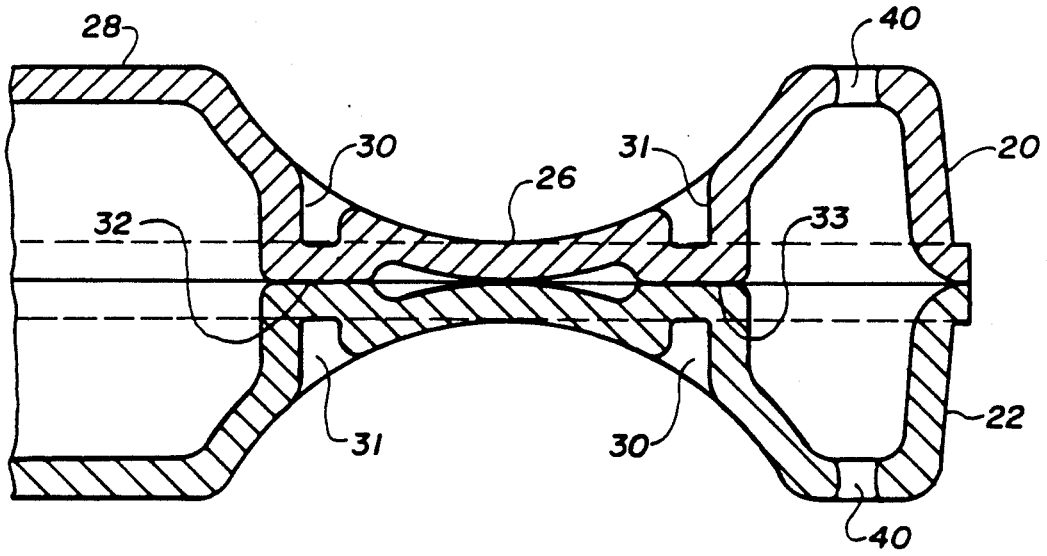
FIG. 6 is an enlarged cross section of one end of a middle papier-maché section with the two sections pivoted together and indicating how the lands of one section engage the lands of the other section to provide strength for the middle of the stack, and showing the holes at the ends of the supports for wrapping straps.

Each cradle 26 is provided with two depressions 30 and 31 which project downwardly to form lands 32 and 33, shown best in FIG. 6. When resting on a flat supporting surface such as pallet P, the lands 32 and 33 of supports 20 and 22 engage such surface.

The wall sections 28 between the cradles 26 have diverging sloped side walls 29 along seam line 24. The upper ends of the walls 29 of support section 20 are thus spaced from the upper ends of such walls of support section 22 whereby pivoting one support section relative to the other is facilitated, see dotted line portions in FIG. 5.

When sections 20 and 22 are molded, cradles or pockets are formed to receive a particular diameter of rolls to be supported. Further, the mixture of material of short and long fibers is established to produce a stable papier-maché structure having rigidity and at the same time some flexibility in relation to the weight of the rolls to be carried. This allows the supports to conform to the rolls to be stacked, where some of the rolls may be undersized, oversized or out of round. When subjected to roll supporting weight, the sections 20 and 21 will limitedly remold to fit the rolls.

To form a stack, support sections 20 and 21 of one molded piece are pivoted relative to each other along the seam line 24 to break them apart. Generally, folding the two halves relative to each other two or three times, will result in the two support sections separating. Or, a knife or other means can be used to cut along the indentation 25 to separate the support sections 20 and 21 from each other. When so separated into two distinct pieces, both sections 20 and 22 may be used as bottom supports 16 on the pallet P to receive the lower tier of rolls 12. At the bottom of the stack, two, three or more sections 16 may be used depending on the length of the rolls to be supported and the weight of the stack to be formed. When positioned at the bottom of the stack, the lands 32 and 33 of depressions 30 and 31 engage the surface of the pallet.

Figure 5:
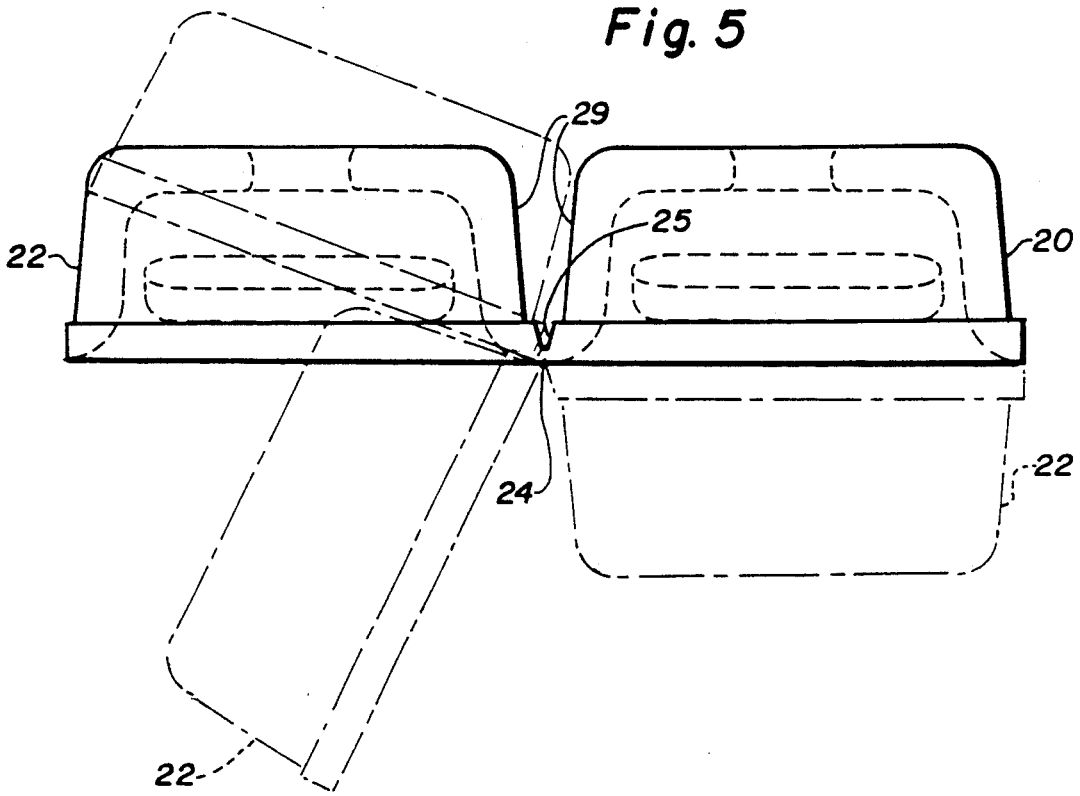
FIG. 5 is an enlarged end view showing in dotted lines how one section is adapted to be pivoted relative to a second section whereby one section may be moved beneath and in register with an upper section.

After the lower tier of rolls is formed, middle roll tiers are arranged supported by middle support sections 14. To provide a middle support, support section 22 is pivoted 180 as shown in FIG. 5 to move it from a position along side support section 20 to a second position beneath and in register with the bottom of section 20. Sections 20 and 22, although pivoted relative to each other remain connected along seam line 24.

Figure 4:
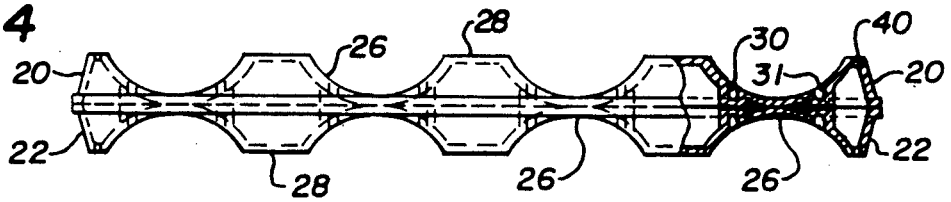
FIG. 4 is a side view showing one of the support sections folded and pivoted downwardly to provide a middle support having one section with upwardly facing roll receiving cradles and a second section having downwardly facing roll cradles, strengthening lands on one section engaging similar lands on the second section, as shown in cross section.

When in pivoted position, the cradles 26 in section 22 face downwardly and the cradles 26 in section 20 face upwardly, see FIG. 4. Therefore, the cradles in downwardly facing support 22 can be placed on top of the lower tier of rolls 12 with the upper section 20 having cradles 26 facing upwardly to receive the next tier of rolls. As many middle supports 14 are provided as are needed until a desired height of roll stack is achieved. The person forming the stack merely takes each molded structure with its two supports 20 and 22 and pivots them relative to each other to form a middle support 14. When the top of the stack is reached, separated sections 20 and 22 are used with the cradles facing downwardly to engage the top tier of rolls.

As shown best in FIG. 6, when the two support sections 20 and 22 are pivoted relative to each other, wherein section 22 is brought into register with the bottom of section 20, the lands 32 and 33 of section 22 come into engagement with the corresponding lands in support section 20. This strengthens the overall structure so that when rolls are formed in tiers, one on top of the other, a secure support is provided for each roll tier.

When the stack is complete as shown in FIG. 1, securing straps S may be provided. To receive these straps the ends of support sections 20 and 22 are provided with holes 40 molded into the supports. If desired, when the entire package is complete, it may be enclosed in a suitable plastic or other material wrap to protect the rolls.

The supports provided by this invention provide a means for building a sturdy stack of rolls and a low cost package. The molded papier-maché can be made from scrap, recycled paper, cardboard and the like. The support sections have strength and rigidity, yet enough flexibility to accommodate variations in roll shapes.

When the support sections 20 and 22 come out of the molding machine, they are inter-connected in side-by-side relationship. Only one mold design is required. When middle supports are needed, the assembler merely folds one papier-maché section relative to the other to provide internal supports 14 with both upwardly and downwardly facing cradles. When top or bottom supports are needed, the support sections are separated from each other and located as desired to form bottom or top supports sections 16 and 18. When used as bottom supports, the lands 32–33 provide stability.

Being fabricated from paper, the supports are biodegradable. They are subject to recycling or disposal in a landfill. If there is a fire when the support elements are being stored or used in a stack, safer fumes will be given off.

With this invention, middle support sections and top and bottom support sections are provided from the same molded components. Therefore, when a roll stack is to be constructed, the person building the stack can easily have top, bottom and middle sections all from the same molded pieces and having the fractures provided by this invention.

The diameters of the cradles can be varied to accommodate different sizes of rolls. Support sections will be manufactured according to the needs of the purchaser. Further, the mix of the papier-maché can be varied to make the supports of greater or less rigidity depending upon the weight of the rolls to be supported. More rigid support elements will be used when the roll weight is greater and additional flexibility may be provided when the rolls are of lighter material.

Although this invention has been described in connection with a particular embodiment thereof, it will be understood that the invention may be practiced using other materials and arrangements according to the teachings described herein. Although the invention has been described as providing means for building a stack of rolls, items other than rolls may be similarly stacked following the teachings of this invention. This Application is intended to cover any variations adapting the design disclosed herein.

Having thus described our invention, what we claim is:

1. Supports molded from papier-mache and adapted to hold tiers of cylindrical rolls in a stack, comprising:

each support having a horizontally extending elongated body with transverse arcuate roll receiving cradles spaced from each other on one side of the support and being planar on a side opposite said one side, lands projecting from each cradle from said one side of each support toward said opposite side and each land having a surface co-planar with said opposite side, said lands being so located that when two supports are placed in register with said opposite sides abutting, the lands on one support engage the lands on the other support, a stack being formed by a plurality of supports on a horizontally extending surface with cradles facing upwardly and arranged with the cradles in one support aligned with the cradles in another support to carry a first bottom tier of rolls, each cradle having a depth less than the radius of each roll and a portion of each roll extending upwardly of said cradle, a second tier of rolls being carried on pairs of roll supports carried on top of the first tier, the first support of each of said pairs of roll supports, being mountable on the surface of the bottom rolls with their cradles facing downwardly, the second support of each of said pairs of roll supports being mountable on the first support of the pair with its cradles facing upwardly and said lands on one of said pairs of roll supports engaging the lands on the other of the pair of roll supports, a top tier of rolls being carried on the second supports of each pair of supports beneath the top tier, a plurality of top supports mounted on said top tier of rolls with their cradles facing downwardly and their planar sides facing upwardly, and the lands on said supports providing separate vertically extending support columns from the bottom to the top of the stack and assisting to securely holding said rolls in place.

2. Supports molded from papier-mache as recited in claim 1 wherein said supports are formed in first and second elongated support sections extending side by side and interconnected along a seam line along one longitudinal edge of each support section.

3. Supports molded from papier-mache as recited in claim 1 wherein said first and second support sections may be selectively separated from each other to provide two disconnected support sections or said second section being foldable downwardly relative to said first section along said seam line to pivot to a position beneath and in register with the first section, the cradles on the first section facing upwardly and the cradles of the second section facing downwardly, and said lands on said first and second sections engaging each other when the second section is folded beneath the first section.

4. Supports as recited in claim 3 wherein the cradles in each support rate separated by wall sections along said seam sloped away from each other whereby pivoting the support sections of a given pair relative to each other is facilitated.

5. Supports as recited in claim 1 wherein the ends of said supports are slotted to receive straps for banding a plural tier of rolls in a completed stack.

* * * * *